United States Patent [19]

Ito et al.

[11] 4,329,174

[45] May 11, 1982

[54] NICKEL ALLOY FOR SPARK PLUG ELECTRODES

[75] Inventors: Tsuneo Ito; Junichi Kagawa, both of Nagoya, Japan

[73] Assignee: NGK Spark Plug Co., Ltd., Aichi, Japan

[21] Appl. No.: 73,589

[22] Filed: Sep. 7, 1979

[30] Foreign Application Priority Data

Sep. 7, 1978 [JP] Japan ..... 53-109906

[51] Int. Cl.[3] ..... C22C 19/03

[52] U.S. Cl. ..... 420/433; 420/455

[58] Field of Search ..... 75/170, 171; 148/32, 148/32.5

[56] References Cited

U.S. PATENT DOCUMENTS 3,810,754 5/1974 Ford et al. ..... 75/171

4,174,964 11/1979 Shaw et al. ..... 75/171

*Primary Examiner*—R. Dean

*Attorney, Agent, or Firm*—Sughrue, Mion, Zinn, Macpeak and Seas

[57] ABSTRACT

A nickel alloy for spark plug electrodes consisting essentially of, by weight percent, about 0.2 to 3% Si about 0.5% Mn or less at least two metals selected from the group consisting of about 0.2 to 3% Cr about 0.2 to 3% Al and about 0.01 to 1% Y and the balance nickel.

6 Claims, 2 Drawing Figures

NICKEL ALLOY FOR SPARK PLUG ELECTRODES

BACKGROUND OF THE INVENTION

1. Field of the Invention

This invention relates to a Ni-Si alloy for spark plug electrodes with high heat resistance and low wear which contains a small amount of Cr-Al, Cr-Al-Y, Al-Y or Cr-Y. The invention further relates to a nickel alloy for spark plug electrodes with good characteristics which contains not more than about 0.5 wt % of Mn as a deoxidizing agent.

2. Description of the Prior Art

A nickel alloy for use in spark plug electrodes must be resistant to (1) oxidative wear, (2) spark wear, and (3) corrosion by internal combustion residues typified by PbO. In addition, a Ni electrode with a copper core which has recently been developed to expand the utility (heat range) of spark plugs must have high plastic workability. Consequently, this new type of Ni electrode can only accommodate up to about 3 wt % of additives, and the use of elements which do not contribute to improve the properties of the alloy must be minimized.

SUMMARY OF THE INVENTION

A principal object of the present invention is to provide a Ni-Si-Mn alloy having improved oxidative wear and spark wear characteristics and improved resistance to PbO corrosion.

A more particular object of the present invention is to provide a Ni-Si-Mn alloy in which the Mn content is limited to the minimum required to achieve deoxidation and desulfurization during casting and in which the aforementioned properties are obtained.

As a result of studies of Ni-alloys incorporating Al, Cr, Si, Ti, Mn and Y as elements to alter the characteristics of the alloy used as a spark plug electrode, it has been found contrary to traditional observations, that the addition of Ti and Mn causes serious deterioration of the electrode material. Ti and Mn combine with other elements in the alloy to make the alloy less workable.

The nickel alloys which have been used heretofore and contained Mn have contained substantially higher amounts of Mn than used in the present invention. Japanese Pat. No. 25996/69 discloses a Ni-Al-Y alloy and that alloy modified with a combination of Mn and Si. The Ni-Al-Y alloy, however, has poor oxidation resistance at high temperatures but the Ni-Al-Mn-Si-Y alloy not only has poor oxidation resistance but poor spark wear resistance and workability due to the large amount of Mn present. In a similar vane, Japanese Pat. No. 7837/69 discloses a Ni-Y-Cr alloy having poor oxidation resistance and workability which is modified with a combination of Mn and Si. The modified alloy, however, has poor spark wear resistance, poor workability and poor oxidation resistance due to the large Mn content. U.S. Pat. No. 2,071,645 discloses a Ni-Al-Mn alloy and an Ni-Al-Cr alloy. The Mn-containing alloy has poor oxidation resistance and workability whereas the Cr-containing alloy also has poor workability.

As a result of extensive tests, the inventors have succeeded in improving greatly the characteristics of the conventional Ni-Si-Mn alloy as a material for use as a spark plug electrode by incorporating Cr-Al, Cr-Al-Y, Al-Y or Cr-Y in the alloy and limiting the Mn content in the Ni-Si-Mn alloy to not more than about 0.5 wt % which is a minimum value for achieving deoxidation and desulfurization in casting (pouring or ingot making), and greater use of Mn only results in impairing the properties of a spark plug electrode.

DETAILED DESCRIPTION OF THE INVENTION

Figure 1:
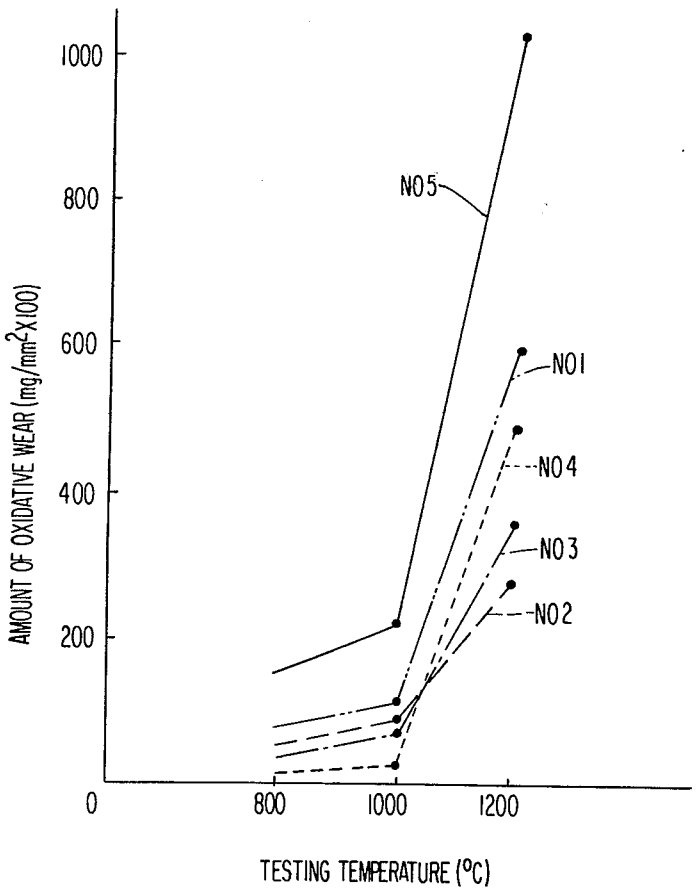
FIG. 1 is a comparison of characteristic curves for oxidative wear in air atmosphere for the Ni alloy of this invention and the conventional product.

The nickel alloy for spark plug electrodes according to the present invention consists essentially of, by weight percent, about 0.2 to 3% Si
about 0.5% Mn or less
at least two metals selected from the group consisting of
  about 0.2 to 3% Cr
  about 0.2 to 3% Al and
  about 0.01 to 1% Y and the balance nickel.

Manganese is effective for deoxidation and desulfurization in pouring, but it does not improve the characteristics of a spark plug electrode. It is very detrimental to oxidation resistance and spark wear resistance. Therefore, the Mn content in the nickel alloy of this invention does not exceed about 0.5 wt %, which is the minimum requirement for deoxidation.

Silicon is very effective for making the Ni-alloy resistant to oxidation at temperatures in the range of about 600° C. to higher temperatures (normal operating temperatures for a spark plug). It remarkably reduces the spark wear, but use of more than about 3 wt % Si reduces the workability of the alloy and at least about 0.2 wt % Si is needed to achieve the desired anti-oxidation effect. The amount of silicon is preferably about 0.5 to 2.5 wt %.

Aluminum is effective for making the Ni-alloy resistant to oxidation at temperatures between normal temperature and 1,000° C. Aluminum is effective after Si in regard to spark wear resistance. Using more than about 3 wt % Al results in excessively poor workability. Using less than about 0.2 wt % Al results in deterioration of the anti-oxidation ability of the alloy at high temperatures, spark wear resistance and Pb corrosion. The amount of aluminum is preferably about 0.5 to 2.5 wt %.

Chromium is not particularly effective for rendering the Ni alloy oxidation resistant or spark wear resistant but is very effective against corrosion by Pb compounds. A Cr content of at least about 0.2 wt % is sufficient to make the Ni-alloy resistant to Pb corrosion, and more than about 3 wt % Cr results in poor workability. The amount of chromium is preferably about 0.5 to 2.5 wt %.

Yttrium is not particularly effective for providing the Ni alloy with spark wear resistance, but is very effective against oxidation and Pb corrosion. Using more than about 1 wt % Y results in poor workability and using less than about 0.01 wt % Y results in deterioration of the anti-oxidation, spark wear resistance and Pb corrosion resistance. The amount of yttrium is preferably about 0.1–0.5 wt %.

As described in the foregoing, each elemental additive has its own merits and demerits in regard of the respective characteristics of a spark plug electrode. Therefore, optimum content and combinations of these additives must be determined by balancing various factors such as use of a leaded or unleaded fuel, operating temperature and atmosphere. Various tests have revealed that a spark plug electrode can be provided with improved characteristics by adding to a Ni alloy a strictly limited amount of Mn necessary for deoxidation and by incorporating at least two elements selected from the group consisting of Al, Cr and Y.

This invention is hereunder described in greater detail by reference to the following example which is given here for illustrative purposes only and is by no means intended to limit the scope of the invention.

EXAMPLE

Five nickel alloys for spark plug electrodes having the compositions set forth in the table below, four (Nos. 1 to 4) of which were according to this invention and the other (No. 5) conventional, were produced by vacuum melting and made into wires each having a diameter of 4 mm, which were tested for oxidative wear, spark wear and corrosion by PbO.

TABLE

| Sample No. | Composition (wt %) | | | | | |
|---|---|---|---|---|---|---|
| | Si | Mn | Cr | Al | Y | Ni |
| 1 | 2.0 | 0.2 | 1.0 | 2.0 | — | balance |
| 2 | 2.0 | 0.2 | — | 2.0 | 0.5 | balance |
| 3 | 2.0 | 0.2 | 1.0 | — | 0.5 | balance |
| 4 | 2.0 | 0.2 | 1.0 | 2.0 | 0.5 | balance |
| 5 | 3.0 | 3.0 | — | — | — | balance |

Testing Methods

Oxidative Wear

Stored in electric furnace at heated atmospheric temperatures of 800° C., 1,000° C. and 1,200° C. for 10 hours, and oxidative wear was evaluated in terms of the weight of oxidized film coming off the surface. The results are given in FIG. 1.

Spark Wear

Figure 2:
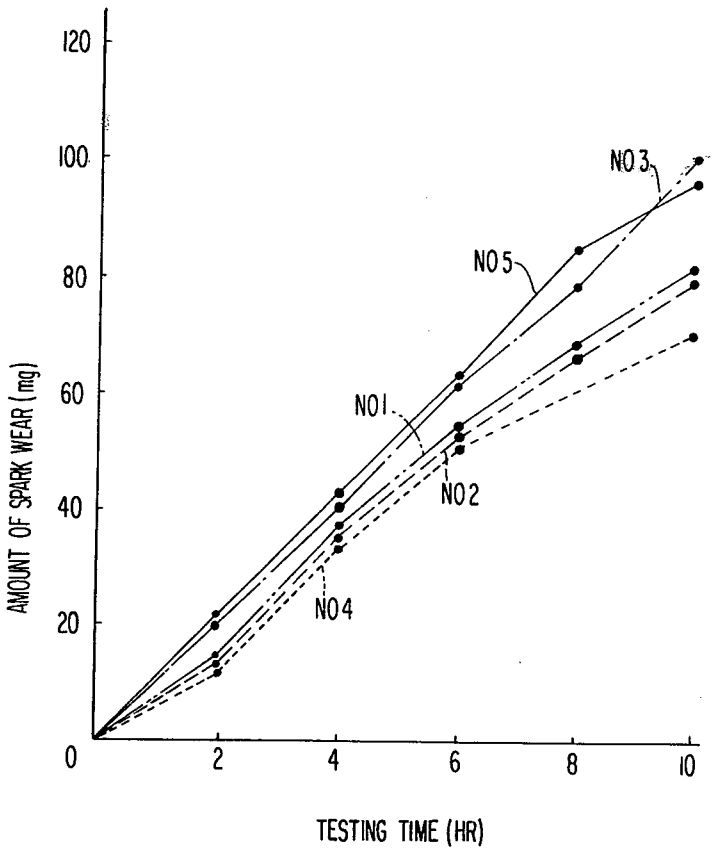
FIG. 2 is a comparison characteristic curves for spark wear in air atmosphere.

A neon transformer was used to apply continuously a voltage of 15 KV across coaxial electrodes with a spark gap of 2.0 mm in atmosphere, and wear was measured every 2 hours. The results are shown in FIG. 2.

PbO Corrosion

Samples Nos. 4 and 5 were embedded in PbO powder, heated at 850° C. for 10 hours, recovered from the powder, and excess PbO was removed with acetic acid for observation of the degree of corrosion. Sample No. 4 had a substantially corrosion free appearance, whereas No. 5, the conventional nickel alloy for spark plug electrode, was corroded to half of the original volume or less.

The requirement of this invention that the Mn content not exceed 0.5 wt % is demonstrated in the following table which shows the results of test for the oxidation wear, spark wear and PbO corrosion of a Ni-3.0 wt % Si alloy as compared with the respective types of wear developed in the known Ni alloy (Ni-3.0wt % Si-3.0 wt % Mn) and which was assigned 100%.

| Oxidative Wear | | | Spark Wear | PbO Corrosion |
|---|---|---|---|---|
| 800° C. | 1,000° C. | 1,200° C. | | |
| 50% | 64.5% | 68% | 90.0% | 75.2% |

As the above table shows, Mn impairs rather than improves the characteristics of a spark plug electrode. The Mn content in the Ni alloy of this invention should not exceed about 0.5 wt % because in an industrial scale operation, the vacuum required for vacuum melting tends to be lost, and thus about 0.2 wt % of deoxidizing agent is required. Potential variation in the operation conditions may increase the required amount of the agent up to about 0.5 wt %.

While the invention has been described in detail and with reference to specific embodiments thereof, it will be apparent to one skilled in the art that various changes and modifications can be made therein without departing from the spirit and scope thereof.

What is claimed is:

1. A nickel alloy for spark plug electrodes consisting essentially of, in weight percent, about 0.2 to 3% Si about 0.5% Mn or less and additionally containing one of (a), (b) or (c) below (a) about 0.2 to 3% Cr, and about 0.01 to 1% Y, (b) about 0.2 to 3% Al and about 0.01 to 1% Y, (c) about 0.2 to 3% Cr, about 0.2 to 3% Al and about 0.1 to 1% Y, and the balance nickel.

2. A nickel alloy for spark plug electrodes consisting essentially of, in weight percent, about 0.5 to 2.5% Si about 0.5% Mn or less and additionally containing one of (a), (b) or (c) below (a) about 0.5 to 2.5% Cr, and about 0.1 to 0.5% Y, (b) about 0.5 to 2.5% Al and about 0.1 to 0.5% Y, or (c) about 0.5 to 2.5% Cr, about 0.5 to 2.5% Al and about 0.1 to 0.5% Y, and the balance nickel.

3. The nickel alloy of claim 1, wherein said alloy contains 0.2 to 3.0 wt % Cr, 0.2 to 3.0 wt % Al and 0.01 to 1.0 wt % Y.

4. The nickel alloy of claim 1, wherein said alloy contains 0.2 to 3.0 wt % Al and 0.01 to 1.0 wt % Y.

5. The nickel alloy of claim 1, wherein said alloy contains 0.2 to 3.0 wt % Cr and 0.01 to 1.0 wt % Y.

6. The nickel alloy of claim 1 containing Mn.

* * * * *